US007616912B2

(12) United States Patent
Nishimura et al.

(10) Patent No.: US 7,616,912 B2
(45) Date of Patent: Nov. 10, 2009

(54) IMAGE FORMING APPARATUS INCLUDING A CHARGER AND INTAKE/EXHAUST

(75) Inventors: Yasuhiro Nishimura, Yamatokoriyama (JP); Toshiaki Ino, Kyoto (JP); Mitsuru Tokuyama, Kyoto (JP); Takashi Kitagawa, Yamatokoriyama (JP); Kiyofumi Morimoto, Tenri (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 297 days.

(21) Appl. No.: 11/444,391

(22) Filed: Jun. 1, 2006

(65) Prior Publication Data

US 2006/0275048 A1 Dec. 7, 2006

(30) Foreign Application Priority Data

Jun. 3, 2005 (JP) ..... 2005-164788

(51) Int. Cl.
*G03G 21/20* (2006.01)

(52) U.S. Cl. ..... 399/92

(58) Field of Classification Search ..... 399/92, 399/94, 91, 96

See application file for complete search history.

(56) References Cited

U.S. PATENT DOCUMENTS 5,081,496 A * 1/1992 Takeda ..... 399/92
5,138,375 A * 8/1992 Iimori ..... 399/92
6,219,504 B1 * 4/2001 Matsuzaki et al. ..... 399/92
2006/0024083 A1 * 2/2006 Hori et al. ..... 399/93
2007/0071484 A1 * 3/2007 Igarashi ..... 399/92

FOREIGN PATENT DOCUMENTS

JP 05216321 A * 8/1993
JP 06167857 A * 6/1994
JP 9-26731 A 1/1997
JP 2000-206841 A 7/2000
JP 2002006697 A * 1/2002
JP 2002-196635 A 7/2002
JP 2002196635 A * 7/2002
JP 2004109538 A * 4/2004
JP 2004-163770 A 6/2004

* cited by examiner

*Primary Examiner*—Quana M Grainger
(74) *Attorney, Agent, or Firm*—Birch, Stewart, Kolasch & Birch, LLP

(57) ABSTRACT

The image forming apparatus according to the present invention carries out intake and exhaust so as to generate air flow between a photoconductor drum and a charger in a long side direction of the charger. As a result, it is possible to always exhaust $O_3$, NOx, and the like caused by corona discharge. Therefore, it is possible to always form a high-quality image without deterioration of images caused by charge unevenness.

28 Claims, 14 Drawing Sheets

FIG. 10

| | |
|---|---|
| ○ | NO STREAK IS GENERATED |
| ○△ | A FEW THIN STREAKS ARE GENERATED |
| △ | THIN STREAKS ARE GENERATED OVERALL |
| △× | ONE OR MORE THICK STREAKS ARE GENER |
| × | THICK STREAKS ARE GENERATED OVERALL |

FIG. 11

| WIND SPEED ( m/s ) | | | CHARGE UNEVENNESS | | X' |
|---|---|---|---|---|---|
| INTAKE SECTION | EXHAUST SECTION | IN MC (x) | OCCURRING NUMBER | LEVEL | |
| 0 | 2.12 | 0 | 10K | △ | 0.00 |
| 4 | 2.12 | 0.42 | 26K | △ | 0.22 |
| 6 | 2.12 | 0.99 | 50K | △ | 0.98 |
| 7 | 2.12 | 1.35 | 75K | △ | 1.69 |
| 8 | 2.12 | 1.55 | 105K | △ | 2.15 |
| 8.92 | 2.12 | 2.03 | 180K | △ | 3.45 |

FIG. 14

EXPERIMENT NO. 1 CONVENTIONAL PROCESS + CONVENTIONAL EXHAUST
PROCESS CONDITION CONVENTIONAL
INTAKE WIND SPEED=-m/s
EXHAUST WIND SPEED=2.12m/s

| PROCESS SPEED | INI | 5K | 10K |
|---|---|---|---|
| 167mm/s | ○ | ○△ | △ |
| 225mm/s | ○ | ○△ | △ |

EXPERIMENT NO. 2 NATURAL INTAKE + CONVENTIONAL EXHAUST
PROCESS CONDITION FIG. 1
INTAKE WIND SPEED=0m/s NATURAL INTAKE
EXHAUST WIND SPEED=2.12m/s

| PROCESS SPEED | INI | 5K | 10K |
|---|---|---|---|
| 167mm/s | ○ | ○ | △ |
| 225mm/s | ○ | ○ | △ |

EXPERIMENT NO. 3 COMPULSORY INTAKE+CONVENTIONAL EXHAUST
PROCESS CONDITION FIG. 1
INTAKE WIND SPEED=4m/s
EXHAUST WIND SPEED=2.12m/s

| PROCESS SPEED | INI | 20K | 26K | 27.8K |
|---|---|---|---|---|
| 167mm/s | ○ | ○ | △ | △ |
| 225mm/s | ○ | ○ | ○ | △ |

EXPERIMENT NO. 4 COMPULSORY INTAKE+CONVENTIONAL EXHAUST
PROCESS CONDITION FIG. 1
INTAKE WIND SPEED=6m/s
EXHAUST WIND SPEED=2.12m/s

| PROCESS SPEED | INI | 30K | 40K | 50K |
|---|---|---|---|---|
| 167mm/s | ○ | ○ | ○ | ○ |
| 225mm/s | ○ | ○ | ○ | ○△ |

EXPERIMENT NO. 5 COMPULSORY INTAKE+CONVENTIONAL EXHAUST
PROCESS CONDITION FIG. 1
INTAKE WIND SPEED=8.92m/s
EXHAUST WIND SPEED=2.12m/s

| PROCESS SPEED | INI | 5K | | 60K | 64K | 70K | 70K | |
|---|---|---|---|---|---|---|---|---|
| 167mm/s | ○ | ○ | … | ○ | ○ | ○ | ○ | … |
| 225mm/s | ○ | ○ | | ○ | ○ | ○ | ○ | … |

EXPERIMENT NO.6 NATURAL INTAKE+EXHAUST UP②
PROCESS CONDITION FIG. 1
INTAKE WIND SPEED=0m/s NATURAL INTAKE
EXHAUST WIND SPEED=5.05m/s

| PROCESS SPEED | INI | 10K | 15K | 20K |
|---|---|---|---|---|
| 167mm/s | ○ | ○△ | ○△ | △ |
| 225mm/s | ○ | △ | △ | △× |

FIG. 15

EXPERIMENT NO. 7 CONVENTIONAL PROCESS+CONVENTIONAL EXHAUST

PROCESS CONDITION CONVENTIONAL ※K/C/M/Y

INTAKE WIND SPEED=–m/s

EXHAUST WIND SPEED=2.12/2.14/1.90/1.85m/s

| | POSITION | INI | 3K | 5K | 7.5K | 10K | 12.8K |
|---|---|---|---|---|---|---|---|
| 167 | BK | ○ | ○ | ○ | ○△ | ○△ | △ |
| 167 | C | ○ | ○ | ○ | △ | △× | × |
| 167 | M | ○ | ○ | ○ | △ | △× | × |
| 167 | Y | ○ | | | | | |
| 225 | BK MONOCHROME | ○ | ○ | ○ | △ | △ | × |

EXPERIMENT NO. 8 COMPULSORY INTAKE+EXHAUST UP①

PROCESS CONDITION FIG. 1 ※K/C/M/Y

INTAKE WIND SPEED=2.25/1.93/2.38/2.16m/s

EXHAUST WIND SPEED=3.27/3.08/2.67/2.70m/s

| POSITION | INI | 10K | 15K | 20K |
|---|---|---|---|---|
| BK | ○ | ○ | ○ | △ |
| C | ○ | ○ | ○ | △ |
| M | ○ | ○ | ○ | × |
| Y | ○ | ○ | ○ | × |
| BK MONOCHROME | ○ | ○ | ○ | △ |

EXPERIMENT NO. 9 COMPULSORY INTAKE+EXHAUST UP③

PROCESS CONDITION FIG. 1 ※K/C/M/Y

INTAKE WIND SPEED=2.25/1.93/2.38/2.16m/s

EXHAUST WIND SPEED=3.75/3.51/3.22/3.30m/s

| POSITION | INI | 10K | 15K | 20K |
|---|---|---|---|---|
| BK | ○ | ○ | ○ | △ |
| C | ○ | ○ | ○ | △ |
| M | ○ | ○ | ○ | △ |
| Y | ○ | ○ | ○ | △ |
| BK MONOCHROME | ○ | ○ | ○ | △ |

EXPERIMENT NO. 10 NATURAL INTAKE+EXHAUST UP③

PROCESS CONDITION FIG. 1 ※K/C/M/Y

INTAKE WIND SPEED=–/–/–/–m/s NATURAL INTAKE

EXHAUST WIND SPEED=3.75/3.51/3.22/3.30m/s

| POSITION | INI | 5K | 10K | 15K |
|---|---|---|---|---|
| BK | ○ | ○ | ○ | △ |
| C | ○ | ○ | ○ | △× |
| M | ○ | ○ | ○ | △× |
| Y | ○ | ○ | ○ | ? |
| BK MONOCHROME | ○ | ○ | ○ | △× |

EXPERIMENT NO. 11 CONVENTIONAL PROCESS+EXHAUST UP③

PROCESS CONDITION CONVENTIONAL ※K/C/M/Y

INTAKE WIND SPEED=–/–/–/–m/s

排気風速=3.75/3.51/3.22/3.30m/s

| POSITION | INI | 5K | 10K | 11.8K |
|---|---|---|---|---|
| BK | ○ | ○ | ○ | △× |
| C | ○ | ○ | ○△ | × |
| M | ○ | ○ | ○△ | △× |
| Y | ○ | ○ | ○ | △× |
| BK MONOCHROME | ○ | ○ | ○△ | × |

EXPERIMENT NO. 12 NATURAL INTAKE+EXHAUST UP③+PROCESS EXHAUST EFFICIENCY UP

PROCESS CONDITION FIG. 1+EXHAUST EFFICIENCY UP (BOTH ENDS OF MC CASE ARE SEALED WITH URETHANE)

INTAKE WIND SPEED=–/–/–/–m/s NATURAL INTAKE

EXHAUST WIND SPEED=3.75/3.51/3.22/3.30m/s

| POSITION | INI | 5K | 10K | 13.7K |
|---|---|---|---|---|
| BK | ○ | ○ | ○ | △× |
| C | ○ | ○△ | ○△ | △× |
| M | ○ | ○ | ○△ | × |
| Y | ○ | ○ | ○ | △× |
| BK MONOCHROME | ○ | ○ | ○ | △× |

FIG. 16

EXPERIMENT NO. 13 NATURAL INTAKE+EXHAUST UP④

PROCESS CONDITION FIG. 1

INTAKE WIND SPEED=NATURAL INTAKE (0.85m/s)

※RESULT OF MEASUREMENT AT INTAKE FAN IN NATURAL INTAKE

EXHAUST WIND SPEED=6.50m/s

| POSITION | INI | 5K | 10K |
|---|---|---|---|
| BK | ○ | ○ | △× |
| BK MONOCHROME | ○ | ○△ | × |

| EXPERIMENT No. | INTAKE WIND SPEED ( m/s ) | CHARGE UNEVENNESS | |
|---|---|---|---|
| | | OCCURRING NUMBER | LEVEL |
| 2 | 0 | 10K | △ |
| 3 | 4.00 | 26K | △ |
| 4 | 6.00 | 50K | △ |
| 5 | 8.92 | 79K | ○ |

FIG. 19

| EXPERIMENT No. | EXPERIMENT CONDITION | INTAKE WIND SPEED (m/s) | | | | EXHAUST WIND SPEED (m/s) | | | | CHARGE UNEVENNESS | |
|---|---|---|---|---|---|---|---|---|---|---|---|
| | | Bk | C | M | Y | Bk | C | M | Y | OCCURRING NUMBER | LEVEL |
| 8 | COMPULSORY INTAKE + EXHAUST UP① | 2.25 | 1.93 | 2.38 | 2.16 | 3.27 | 3.08 | 2.67 | 2.70 | 20K | △ |
| 9 | COMPULSORY INTAKE + EXHAUST UP③ | 2.25 | 1.93 | 2.38 | 2.16 | 3.75 | 3.51 | 3.22 | 3.30 | 20K | △ |
| 10 | NATURAL INTAKE + EXHAUST UP③ | ? | ? | ? | ? | 3.75 | 3.51 | 3.22 | 3.30 | 15K | △ |
| 13 | NATURAL INTAKE + EXHAUST UP④ | 0.85※ | | | | 6.50 | | | | 5K | △ |
| 12 | NATURAL INTAKE + EXHAUST UP③ + PROCESS EXHAUST EFFICIENCY UP | ? | ? | ? | ? | 3.75 | 3.51 | 3.22 | 3.30 | 10K | △ |
| 2 | NATURAL INTAKE + CONVENTIONAL EXHAUST | ? | | | | 2.12 | | | | 10K | △ |
| 6 | NATURAL INTAKE + EXHAUST UP② | ? | | | | 5.05 | | | | 15K | △ |
| 7 | CONVENTIONAL PROCESS + CONVENTIONAL EXHAUST | | | | | 2.12 | 2.14 | 1.90 | 1.85 | 7.5K | △ |
| 11 | CONVENTIONAL PROCESS + EXHAUST UP③ | | | | | 3.75 | 3.51 | 3.22 | 3.30 | 10K | △ |

※RESULT OF MEASUREMENT AT INTAKE FAN IN NATURAL INTAKE

IMAGE FORMING APPARATUS INCLUDING A CHARGER AND INTAKE/EXHAUST

This non-provisional application claims priority under 35 U.S.C. § 119(a) on Patent Application No. 2005-164788 filed in Japan on Jun. 3, 2005, the entire contents of which are hereby incorporated by reference.

FIELD OF THE INVENTION

The present invention relates to an image forming apparatus including a charger used to charge a surface of an image carrier without touching the surface.

BACKGROUND OF THE INVENTION

A corona charging method has been used as a charging method of an image forming apparatus which adopts electrophotography method, electrostatic recording method, and the like.

The corona charging method is performed in such a manner that: ion caused by corona discharge is led to a surface of an electrostatic latent image carrier of a photoconductor and the like, thereby charging the surface. As such, when charging is performed repeatedly, $O_3$ and NOx generated in corona discharge, toner, paper powder, and the like float near the corona charger. This causes the corona charger to unevenly charge the surface of the image carrier, with a result that defective images are formed.

For example, in a case of a pin array charger which is a kind of the corona charger, foreign matters such as $O_3$ and NOx are attached to an end of a discharge needle, so that the end of the discharging needle causes discharge inhibition and charge unevenness. As a result, defective images are formed. The same phenomenon occurs in a case of a wire charger. This is because: the corona charger discharges electricity while collecting air including the generated $O_3$ and NOx, and floating matters such as toner and paper powder which float in the image forming apparatus.

Therefore, Document 1: Japanese Unexamined Patent Publication No. 026731/1997 (Tokukaihei 09-026731; published on Jan. 28, 1997) discloses an image forming apparatus including exhausting means for exhausting $O_3$, NOx, and the like floating near an image carrier.

Further, Document 2: Japanese Unexamined Patent Publication No. 206841/2000 (Tokukai 2000-206841; published on Jul. 28, 2000) discloses an image forming apparatus including a blowing fan for blowing air to charging means and an intake fan for bringing in air near the charging means.

However, Document 1 has such a problem that: means for removing $O_3$, NOx and the like floating near the image carrier is only the exhausting means and accordingly it is impossible to sufficiently remove $O_3$, NOx and the like.

Further, Document 2 has an arrangement in which the blowing fan and the intake fan are disposed so that the fans are positioned near to each other. As a result, even when an intake fan brings in $O_3$, NOx and the like near a first charger, a blowing fan disposed near the intake fan blows air containing a bit of $O_3$, NOx and the like to the first charger and vicinity thereof. Therefore, as the first charger gets used more frequently, more amounts of $O_3$, NOx and the like are accumulated at the first charger and vicinity thereof, resulting in charge defect in the first charger.

Document 3: Japanese Unexamined Patent Publication No. 163770/2004 (Tokukai 2004-163770; published on Jun. 10, 2004) discloses a technique in which air flows through an absorbing material including polar absorbent, thereby removing materials generated as a result of discharge in charging an image carrier. Further, Document 4: Japanese Unexamined Patent Publication No. 196635/2002 (Tokukai 2002-196635; published on Jul. 12, 2002) discloses a technique in which: openings are provided at both sides of a shield case so as to be positioned in a long side direction, and a blowing fan is provided at one opening and an intake fan is provided at the other opening, and air is caused to flow in a direction in which a charging wire is extended, thereby removing and exhausting materials generated as a result of discharge.

SUMMARY OF THE INVENTION

The present invention was made in view of the foregoing problems. An object of the present invention is to provide an image forming apparatus which prevents $O_3$, NOx and the like floating near charging means from increasing even when the charging means is used more frequently, thereby reducing occurrence of charge defect of the charging means, resulting in always forming high-quality images.

In order to solve the problems, an image forming apparatus according to the present invention includes (i) one or more image carriers each of which forms an electrostatic latent image on a surface of the image carrier and (ii) one or more chargers each of which is disposed near the image carrier and charges the surface of the image carrier, the image forming apparatus comprising gas flow generation means for carrying out intake and exhaust so as to generate a gas flow between the image carrier and the charger in a long side direction of the charger.

With the arrangement, the gas flow generating means carries out intake and exhaust so as to generate a gas flow between the image carrier and the charger in the long side direction of the charger. Therefore, it is possible to always exhaust the gas near the charger. Here, in a case where a corona discharge method is used for the charger, $O_3$, NOx, and the like are generated due to corona discharge. In this case, because of the gas flow near the charger in the long side direction of the charger, $O_3$, NOx, and the like are exhausted.

As a result, even when the charger is used more frequently, $O_3$, NOx, and the like which are causes of charge defect are less likely to be accumulated near the charger, so that it is possible to reduce generation of charge defect (charge unevenness) in the charger. Therefore, it is possible to always form a high-quality image which is free from deterioration of an image caused by charge unevenness.

For a fuller understanding of the nature and advantages of the invention, reference should be made to the ensuing detailed description taken in conjunction with the accompanying drawings.

BRIEF DESCRIPTION OF THE DRAWINGS

FIG. 10 illustrates a reference for determining whether charge unevenness occurs or not.

FIG. 11 illustrates the results of charge-unevenness-occurring numbers corresponding to wind speeds of each section of the intake/exhaust system.

FIG. 14 illustrates the results of Experiments No. 1 to No. 6.

FIG. 15 illustrates the results of Experiments No. 7 to No. 12.

FIG. 16 illustrates the result of Experiment No. 13.

FIG. 19 illustrates the result of comparison between the results of the Experiments No. 2, No. 6 to No. 13.

DESCRIPTION OF THE EMBODIMENTS

The following explains an embodiment of the present invention.

Figure 2:
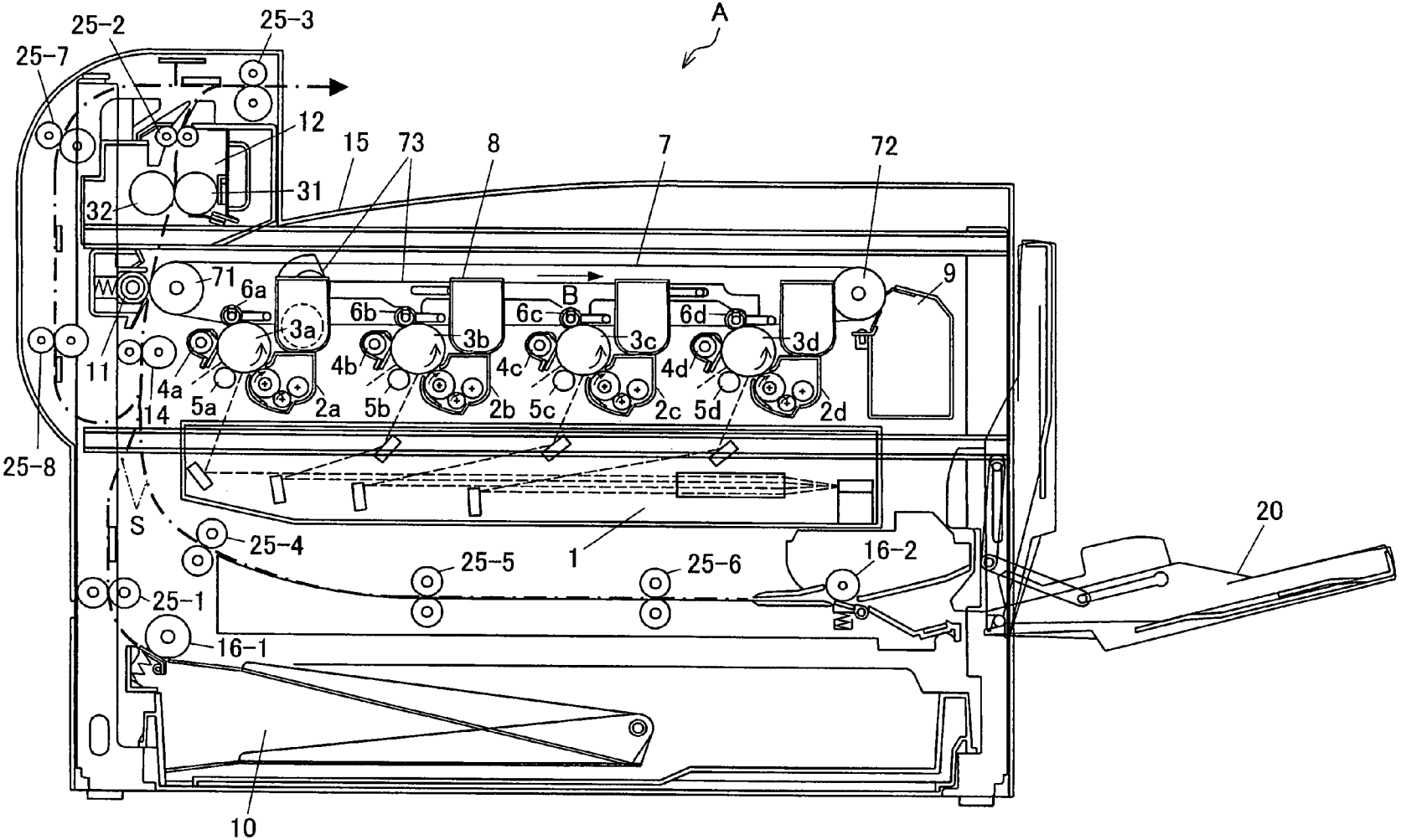
FIG. 2 schematically illustrates an image forming apparatus according to the present invention.

FIG. 2 illustrates a structure of an image forming apparatus A according to the present embodiment. Here, an example of the image forming apparatus A is a laser printer which forms a multi-colored or a single-colored image on a sheet (recording paper) based on (i) image data inputted from an outside or (ii) image data obtained by reading a document.

As illustrated in FIG. 2, the image forming apparatus A includes an exposure unit 1, developing devices 2 (2*a*, 2*b*, 2*c*, and 2*d*), photoconductor drums (image carriers) 3 (3*a*, 3*b*, 3*c*, and 3*d*), chargers 5 (5*a*, 5*b*, 5*c*, and 5*d*), cleaner units 4 (4*a*, 4*b*, 4*c*, and 4*d*), an intermediate transfer belt unit 8, a fixing unit 12, a sheet convey route S, a sheet feeding cassette 10, a sheet delivery tray 15, and the like.

Note that, color image data dealt with in the image forming apparatus A corresponds to a color image using black (K), cyan (C), magenta (M), and yellow (Y). Therefore, the developing devices 2 (2*a*, 2*b*, 2*c*, and 2*d*), the photoconductor drums 3 (3*a*, 3*b*, 3*c*, and 3*d*), the chargers 5 (5*a*, 5*b*, 5*c*, and 5*d*), and the cleaner units 4 (4*a*, 4*b*, 4*c*, and 4*d*) are respectively provided as many as four so as to form four kinds of latent images corresponding to four colors. Reference signs a, b, c, and d are assigned to black, cyan, magenta, and yellow, respectively. The developing devices 2, the photoconductor drums 3, the chargers 5, and the cleaners 4, are discriminated by the reference signs a, b, c, and d. Each of the developing devices 2, each of the photoconductor drums 3, each of the chargers 5, and each of the cleaners 4 constitute each of four image forming stations.

In the image stations, the photoconductor drums 3 are disposed in an upper part of the image forming apparatus A. The chargers 5 are charging means for charging surfaces of the photoconductor drums 3 evenly with a predetermined voltage. An example of the chargers 5 is a non-contact type charger as illustrated in FIG. 2. The chargers 5 are detailed later.

Examples of the exposure unit 1 include: not only a laser scanning unit (LSU) including a laser emitting section and a reflecting mirror illustrated in FIG. 2; but also EL (electro luminescence) or LED (light emitting diode) writing head having light-emitting devices arrayed. The exposure unit 1 exposes the charged photoconductor drums 3 based on input image data so as to form, on the surfaces of the photoconductor drums 3, electrostatic latent images based on the image data.

The developing devices 2 visualize the latent images formed on each of the photoconductor drums 3 by using toners with respective colors (K, C, M, and Y). The cleaner units 4 remove and collect toner remaining on the surfaces of the photoconductor drums 3 after development/image-transfer.

An intermediate transfer belt unit 8 is disposed above the photoconductor drums 3. The intermediate transfer belt unit 8 includes intermediate transfer rollers 6 (6*a*, 6*b*, 6*c*, and 6*d*), an intermediate transfer belt 7, an intermediate transfer belt driving roller 71, an intermediate transfer belt driven roller 72, an intermediate transfer belt tension mechanism 73, and an intermediate transfer belt cleaning unit 9.

The intermediate transfer rollers 6, the intermediate transfer belt driving roller 71, the intermediate transfer belt driven roller 72, the intermediate transfer belt tension mechanism 73, and the like elongate and drive the intermediate transfer belt 7 so that the intermediate transfer belt 7 rotates in a direction of an arrow B.

The intermediate transfer rollers 6 are supported by an intermediate transfer roller attaching section of the intermediate transfer belt tension mechanism 73 included in the intermediate transfer belt unit 8 so as to be rotatable. The intermediate transfer rollers 6 give a transfer bias for transferring toner images of the photoconductor drums 3 onto the intermediate transfer belt 7.

The intermediate transfer belt 7 is disposed so as to be in contact with each of the photoconductor drums 3. Toner images with respective colors, formed on the photoconductor drums 3, are serially superimposed and transferred onto the intermediate transfer belt 7 so that a colored toner image (multi-colored toner image) is formed. The intermediate transfer belt 7 is made of a film whose thickness is 100 through 150 μm so as to be endless.

A toner image is transferred from the photoconductor drums 3 onto the intermediate transfer belt 7 by the intermediate transfer rollers 6 that are in contact with an underside of the intermediate transfer belt 7. A transfer bias having a high voltage (high voltage having a polarity (+) opposite to a charging polarity (−) of toner) is applied to the intermediate transfer rollers 6 so that the intermediate transfer rollers 6 transfer the toner image. Each of the intermediate transfer rollers 6 is constituted of (i) a metal (e.g. stainless steel), whose diameter is 8 through 10 mm, provided as a base and (ii) a conductive elastic member (e.g. EPDM or urethane foam) covering around the base. The intermediate transfer roller 6 can evenly apply a high voltage to the intermediate belt 7 by using the conductive elastic member. The present example uses a roller-shaped transfer electrode (the intermediate transfer roller 6). Besides, a brush-shaped transfer electrode and the like can be used as a transfer electrode.

As described above, electrostatic images respectively on the photoconductor drums 3 are visualized with the toners according to each hue so as to be toner images, and the toner images are laminated on the intermediate transfer belt 7. In this way, the laminated toner images are moved, by rotation of the intermediate transfer belt 7, to a portion where a conveyed paper is in contact with the intermediate transfer belt 7, and the laminated images are transferred onto the paper by the transfer roller 11 disposed at the portion.

At that time, the intermediate transfer belt 7 is pressed to the transfer roller 11 with a predetermined nip, and a voltage (transfer voltage) for transferring the toner images onto the paper is applied to the transfer roller 11. The voltage is a high voltage whose polarity (+) is opposite to a charging polarity (−) of toner.

In order to constantly obtain the predetermined nip, one of the transfer roller 11 and the intermediate transfer belt driving roller 71 is a hard material (such as metal) and the other is a soft material (such as an elastic rubber roller or expandable resin roller).

Mixture of colors is caused in the next step by (i) toner attached to the intermediate transfer belt 7 due to contact with the photoconductor drums 3 or (ii) toner remaining on the intermediate transfer belt 7 because the transfer roller 11 did not transfer the toner on a paper. Therefore, the attaching toner or remaining toner is removed and collected by the intermediate transfer belt cleaning unit 9. The intermediate transfer belt cleaning unit 9 includes a cleaning member such as a cleaning blade contacting with the intermediate transfer belt 7. A portion of the intermediate transfer belt 7 which is in contact with the cleaning blade is supported by the intermediate transfer belt driven roller 72 from the underside.

The sheet feeding cassette 10 is used to store sheets on which images are to be formed, such as recording papers, and is disposed under the image stations and the exposure unit 1. On the other hand, the sheet delivery tray 15 disposed in the upper part of the image forming apparatus A is used to place printed sheets so that printed sides of the sheets face downward.

Further, the image forming apparatus A includes the sheet convey route S used to convey a sheet in the sheet feeding cassette 10 or a sheet in a manual feeding tray 20 to the sheet delivery tray 15 via the transfer roller 11 and the fixing unit 12. The sheet convey route S has a portion extending from the sheet feeding cassette 10 to the sheet delivery tray 15 and, in the portion, there are provided a transfer section including pickup rollers 16, a resist roller 14, and the transfer roller 11, the fixing unit 12, convey rollers 25, and the like.

The convey rollers 25 are small rollers used to prompt/assist conveyance of a sheet and are provided along the sheet convey route S. The pickup rollers 16 are disposed at an end of the sheet feeding cassette 10 and serve as attracting rollers for supplying a sheet to the sheet convey route S. The resist roller 14 temporarily holds a sheet conveyed through the sheet convey route S and conveys the sheet to the transfer section at a timing which allows ends of toner images on the photoconductor drums 3 to overlap with an end of the sheet.

The fixing unit 12 includes a heat roller 31, a pressure roller 32, and the like. The heat roller 31 and the pressure roller 32 rotate so that the former and the latter put a sheet therebetween. The heat roller 31 is controlled by a control section (not shown) so as to have a predetermined fixing temperature. The control section controls the heat roller 31 based on a signal from a temperature detection device (not shown). The heat roller 31 performs thermo compression of a sheet in collaboration with the pressure roller 32 so as to cause toner images having respective colors transferred onto the sheet to be fused/mixed/pressed, thereby fixing the toner images having respective colors onto the sheet. Note that the sheet to which the multi-colored toner image (toner images having respective colors) has been fixed is conveyed to an inverse sheet delivery route of the sheet convey route S by the convey rollers 25, and delivered onto the sheet delivery tray 15 so as to be in an inverted condition (so that the multi-colored toner image faces downward).

Next, the following explains a sheet convey operation performed by the sheet convey route S, which operation includes processes respectively performed by the sections. The image forming apparatus A is provided with the sheet feeding cassette 10 which stores sheets in advance, and the manual feeding tray 20 which is used when the user prints few papers. The sheet feeding cassette 10 and the manual feeding tray 20 are provided with the pickup rollers 16 (16-1 and 16-2), which lead sheets to the covey route one by one.

(Single Side Printing)

A sheet conveyed from the sheet feeding cassette 10 is conveyed to the resist roller 14 via a convey roller 25-1 in the sheet convey route S, and conveyed by the resist roller 14 to the transfer section at a timing that allows an end of the sheet to overlap with ends of toner images laminated on the intermediate transfer belt 7. The toner images are written onto the sheet in the transfer section. The toner images are fixed onto the sheet by the fixing unit 12. Then, the sheet passes through a convey roller 25-2 and delivered onto the sheet delivery tray 15 via a sheet delivery roller 25-3.

Further, a sheet conveyed from the manual feeding tray 20 is conveyed by a plurality of convey rollers 25 (25-6, 25-5, and 25-4) to the resist roller 14. Thereafter, the sheet is delivered onto the sheet delivery tray 15 via the same subsequent processes as those of the sheet conveyed from the sheet feeding cassette 10.

(Double Side Printing)

A back-end of the sheet having been subject to single side printing and having passed through the fixing unit 12 as described above is held by the sheet delivery roller 25-3. Next, the sheet is conveyed to convey rollers 25-7 and 25-8 by inverse-rotation of the sheet delivery roller 25-3. Then, the sheet is subject to back side printing via the resist roller 14, and is delivered to the sheet delivery tray 15.

Figure 3:
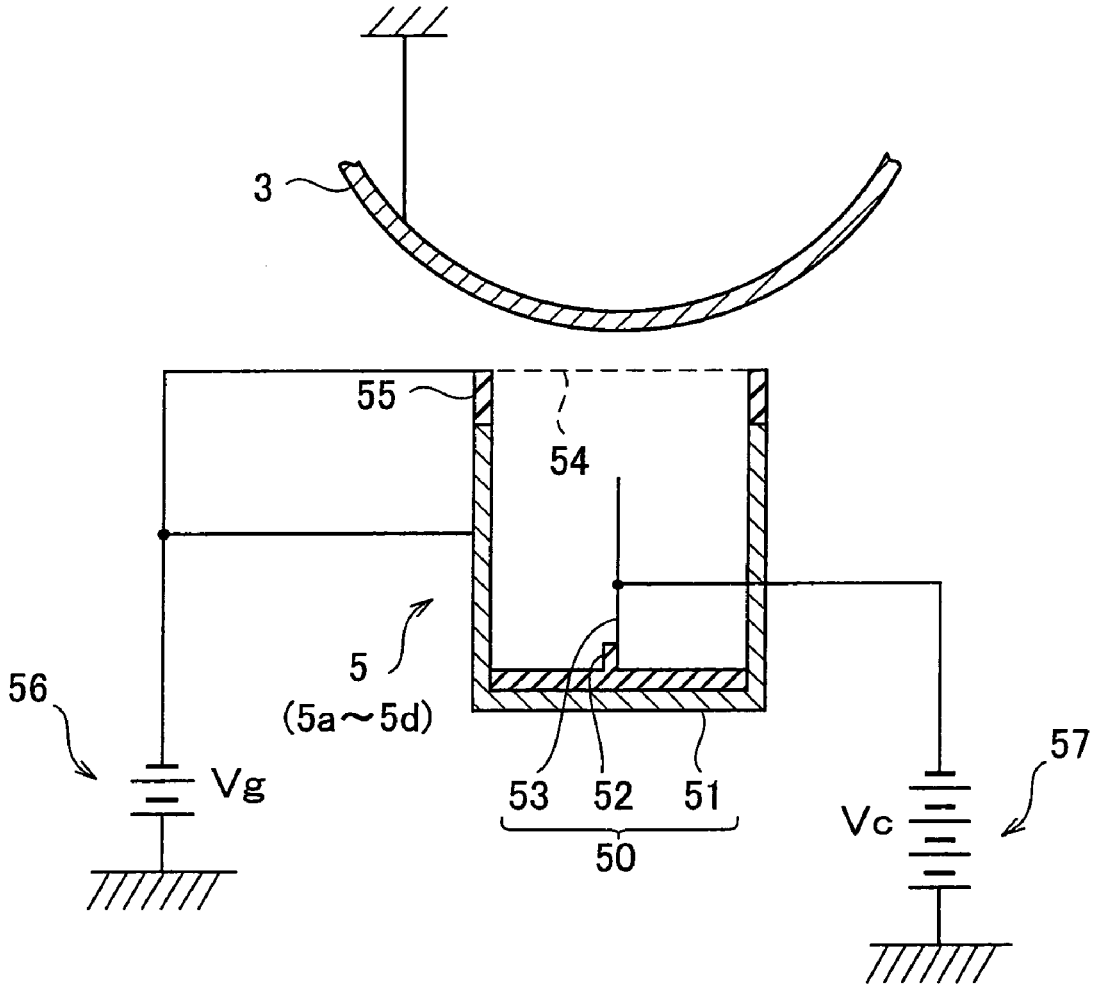
FIG. 3 schematically illustrates how to dispose a charger and a photoconductor drum included in the image forming apparatus illustrated in FIG. 2.
Figure 4:
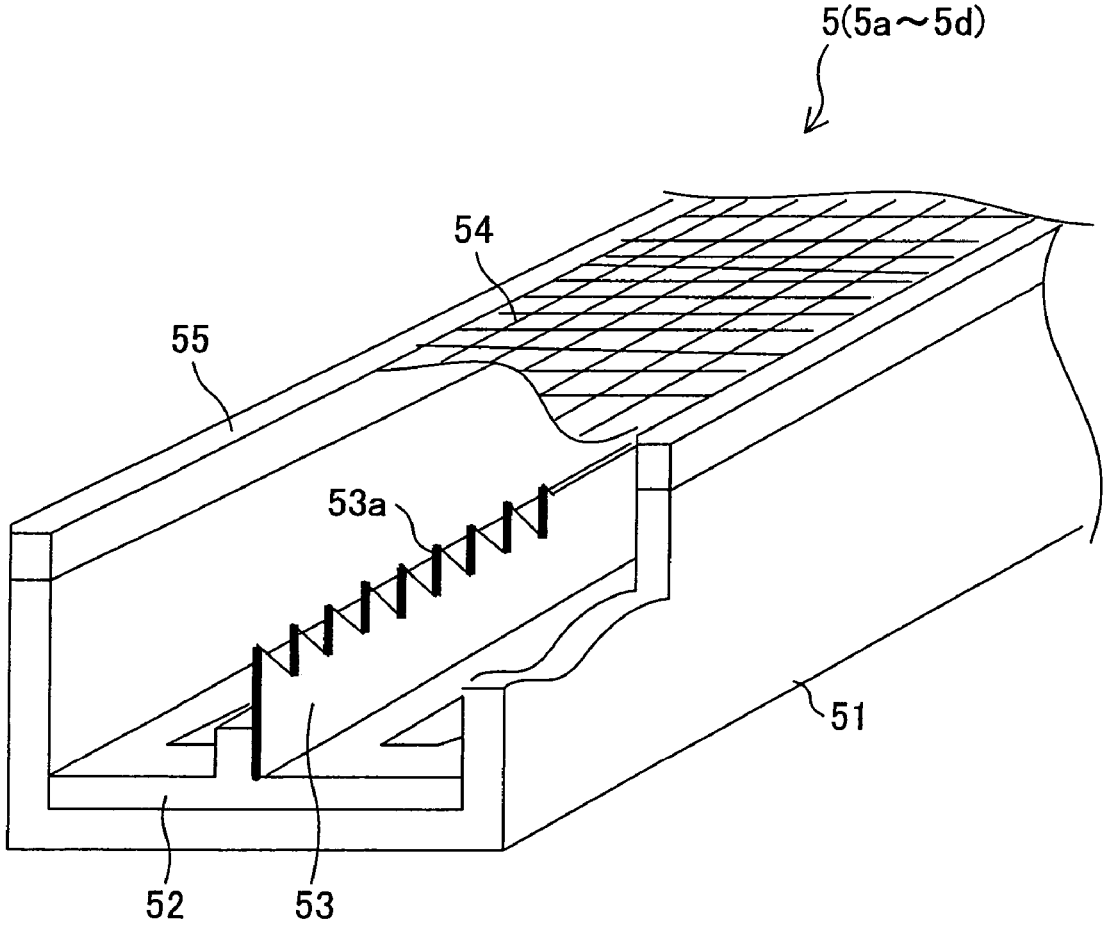
FIG. 4 is an oblique view schematically illustrates the charger illustrated in FIG. 3.

Here, the following explains the chargers 5 with reference to FIGS. 3 and 4. Note that, the four chargers (5*a* to 5*d*) included in the image forming apparatus A illustrated in FIG. 2 have identical structures. Therefore, the chargers 5*a* to 5*d* are not discriminated and generically termed the "charger 5" hereinafter.

FIG. 3 is a cross sectional view schematically illustrating the charger 5 and the vicinity thereof. The charger 5 is a charger based on a corona discharge method. The charger 5 has a length substantially equal to the length of the cylindrical photoconductor drum 3 in a long-side direction (a direction vertical to a plane of the paper FIG. 3) and is disposed along with the photoconductor drum 3.

The charger 5 includes (i) an electric charge generator 50 for generating electric charge, (ii) a grid electrode 54 having a mesh shape, provided between the electric charge generator 50 and the photoconductor drum 3, and (iii) a grid electrode holder 55 for fixing the grid electrode 54 to the electric charge generator 50.

The electric charge generator 50 includes (i) a charger case 51 having a shape obtained by removing, from a square pole, both of bottom faces and a side face, (ii) a discharge electrode 53, and (iii) a discharge electrode holder 52 for fixing the discharge electrode 53 to the charger case 51.

The grid electrode holder 55 and the discharge electrode holder 52 are insulating materials. The grid electrode holder 55 insulates the electric charge generator 50 and the grid electrode 54 from each other. The discharge electrode holder 52 insulates the discharge electrode 53 and the charger case 51 from each other.

A first DC source 56 is connected with the grid electrode 54 and the charger case 51. A potential which is different from the ground potential by Vg (Vg<0) is applied to the grid electrode 54 and the charger case 51. Further, a second DC source 57 is connected with the discharge electrode 53. A potential which is different from the ground potential by Vc (Vc<Vg<0) is applied to the discharge electrode 53. As a result, an electric field is generated between the charger case 51 and the discharge electrode 53 and the electric field ionizes air, so that negative charge (minus ion) is generated near the discharge electrode 53. The generated negative charge is attracted by the grid electrode 54 and moves toward the photoconductor drum 3 while spreading, passes through the grid electrode 54, and reaches the surface of the photoconductor drum 3.

The surface of the photoconductor drum 3 is made of a material which has semi-conductivity while not exposed and has conductivity while exposed. The negative charge reaches the surface of the photoconductor drum 3 as described above, and accordingly the surface of the photoconductor drum 3 is subject to initial charge, thereby having a predetermined initial-charge potential VO. When the surface of the photoconductor drum 3 having been subject to the initial charge is exposed, the exposed portion (bright portion) has conductivity, and accordingly the negative charge moves to the grounding. A potential at the portion from which the negative charge has moved changes positive, and accordingly the portion has a bright-portion potential VE. An electrostatic latent image is constituted of a portion where the negative charge exists and a portion where the negative charge does not exist on the surface of the photoconductor drum 3, namely, constituted of a portion having the initial-charge potential VO and a portion having the bright-portion potential VE.

As illustrated in FIG. 4, the discharge electrode 53 of the charger 5 has a pin-array shape and discharges electricity from an end section 53*a* of the pin array.

In general, in a case of corona discharge, $O_3$, NOx, and the like are generated when ion is generated. As the discharge is more frequently carried out, more $O_3$ and NOx are accumulated. When $O_3$ and NOx are attached to the end section 53*a* of the charger 5, discharge is performed insufficiently and accordingly the charger 5 does not sufficiently charge the photoconductor drum 3, resulting in charge unevenness. Further, toner and paper powder as well as $O_3$ and NOx float near the charger 5. When the toner and paper powder are attached to the end section 53*a* of the charger 5, charging ability of the charger 5 drops.

Figure 1:
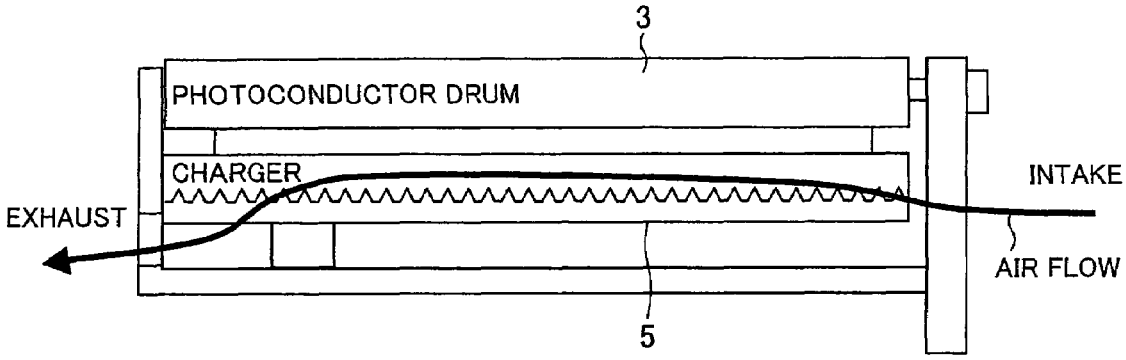
FIG. 1 schematically illustrates an intake/exhaust system of an image forming apparatus according to an embodiment of the present invention.

Therefore, in the present embodiment, as illustrated in FIG. 1, intake and exhaust are carried out so that a flow of gas (air), namely, gas flow is generated in a long side direction between the photoconductor drum 3 serving as an image carrier and the charger 5. Namely, in a long side direction of the portion between the photoconductor drum 3 and the charger 5 (a direction from the right side of FIG. 1 to the left side of FIG. 1), a flow of air is generated by carrying out intake and exhaust. As a result, it is possible to exhaust, by using the flow of air, $O_3$ and NOx which have been generated by corona discharge of the charger 5 and are floating between the photoconductor drum 3 and the charger 5. Therefore, it is possible to always maintain the most suitable charging state.

Figure 5:
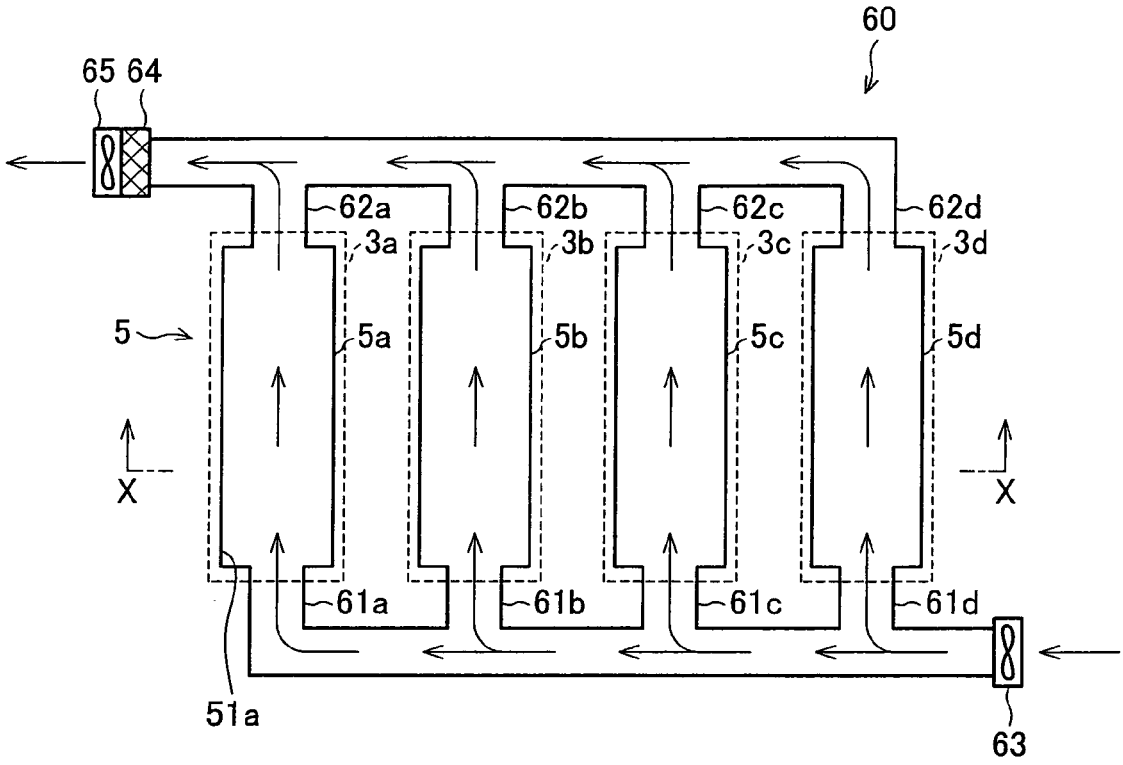
FIG. 5 is a plan view schematically illustrates an essential part of the intake/exhaust system illustrated in FIG. 1.

The flow of air can be realized by an intake/exhaust system 60 (gas flow generating means) illustrated in FIG. 5.

Figure 6:
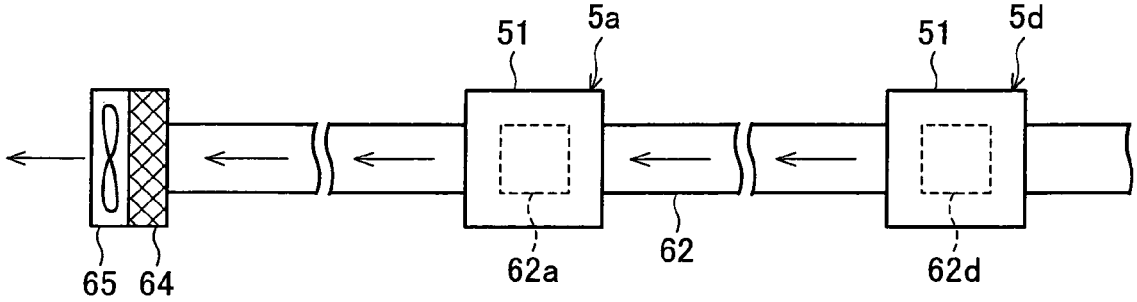
FIG. 6 is a cross sectional view taken in XX line of FIG. 5 illustrating the intake/exhaust system.

FIG. 5 illustrates an outline of the intake/exhaust system 60 used for the charger 5. FIG. 6 is a cross sectional view taken in XX line of FIG. 5 illustrating the intake/exhaust system 60. Note that, in FIG. 6, the discharge electrode 53 and the like included in the charger 5 are omitted and only the charger case 51 is illustrated.

As illustrated in FIG. 5, the intake/exhaust system 60 is provided with ducts (61 and 62) at both ends of each charger case 51 so as to generate a flow of air in a long side direction of the chargers 5 (5*a* to 5*d*). An intake duct 61 for bringing in outside air is provided at an intake side of the charger 5 and an exhaust duct 62 for exhausting air from the charger 5 is provided at an exhaust side of the charger 5.

Namely, the intake/exhaust system 60 includes (i) the intake duct 61 for introducing gas from an outside to the space between the photoconductor drum 3 and the charger 5 and (ii) the exhaust duct 62 for exhausting gas from the space between the photoconductor drum 3 and the charger 5 to the outside.

An intake fan 63 for bringing in outside air is provided at the end of an intake side of the intake duct 61. The intake duct 61 is connected with each charger 5 via connecting ducts 61*a* to 61*d*. An example of the intake fan 63 is BG0703-B054 (Minebea Co., Ltd.).

On the other hand, an exhaust fan 65 for exhausting air from each charger 5 via an ozone filter 64 is provided at the end of an exhaust side of the exhaust duct 62. The exhaust duct 62 is connected with each charger 5 via connecting ducts 62*a* to 62*d*. An example of the exhaust fan 65 is D10F-24PM (Nidec Corporation).

In the intake/exhaust system 60, first, air brought in by the intake fan 63 flows into each charger 5 from the intake duct 61 via the connecting ducts 61*a* to 61*d*. Next, the air having flowed into each charger 5 is attracted by the exhaust fan 65 to the exhaust duct 62 via the connecting ducts 62*a* to 62*d*, passes through the ozone filter 64, and is exhausted from the exhaust fan 65. The ozone filter 64 absorbs $O_3$ generated in the charger 5.

Here, in the intake/exhaust system 60, the speed of air passing through each charger 5, namely, wind speed is suitably set, thereby removing $O_3$, NOx, and the like without fail. The wind speed can be controlled by controlling the rotational frequencies of the intake fan 63 and the exhaust fan 65. Experiments performed to obtain the most suitable value of the wind speed are explained later.

Figure 7:
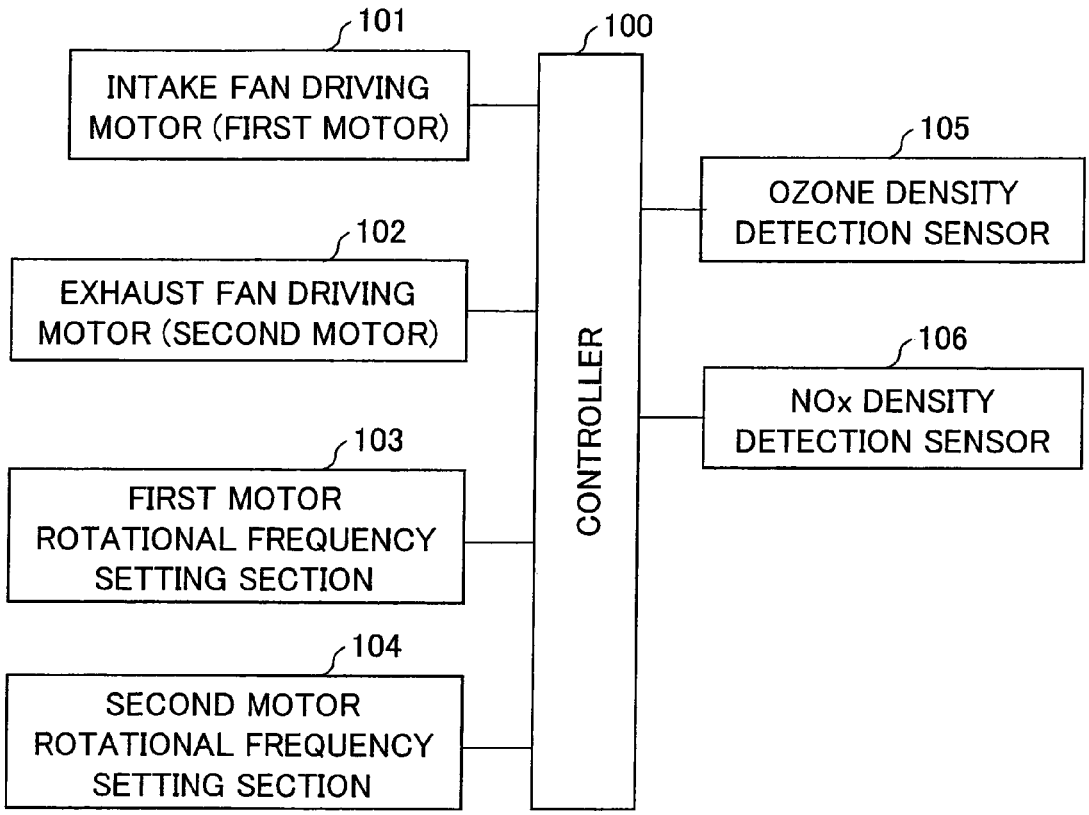
FIG. 7 is a block diagram illustrating a controller included in the image forming apparatus illustrated in FIG. 2.

The rotational frequency of the intake fan 63 and the rotational frequency of the exhaust fan 65 are controlled by a controller (rotational frequency control means, wind speed control means) 100 illustrated in FIG. 7.

The controller 100 is connected with (i) an intake fan driving motor (first motor) 101 for rotating the intake fan 63, (ii) an exhaust fan driving motor (second motor) 102 for driving the exhaust fan 65, (iii) a first motor rotational frequency setting section 103 for setting the rotational frequency of the first motor, and (iv) a second motor rotational frequency setting section 104 for setting the rotational frequency of the second motor.

Namely, the first motor rotational frequency setting section 103 and the second motor rotational frequency setting section 104 respectively set the rotational frequency of the intake fan driving motor 101 and the rotational frequency of the exhaust fan driving motor 102, thereby setting the wind speed in the charger 5 in the intake/exhaust system 60.

Note that, amounts of accumulated $O_3$ and NOx, namely, amounts of floating $O_3$ and NOx change depending on how much time has passed since charging started, and accordingly the wind speed in the charger 5 do not have to have a constant value. Namely, when the amounts of floating $O_3$ and NOx are small, the wind speed is made lower, and when the amounts of floating $O_3$ and NOx are large, the wind speed is made higher, thereby allowing for suitable exhaust of $O_3$ and NOx according to situation.

To be specific, an ozone density detection sensor (density detection means) 105 for detecting density of $O_3$ and an NOx density detection sensor 106 (density detection means) for detecting density of NOx are provided in each charger 5, and the first motor rotational frequency setting section 103 and the second motor rotational frequency setting section 104 respectively set the rotational frequency of the first motor 101 and the rotational frequency of the second motor 102, according to detected values from the ozone density detection sensor 105 and the NOx density detection sensor 106.

In this way, rotational frequencies of the motors are controlled according to $O_3$ density or NOx density in the charger 5. As a result, it is possible to reduce noise caused by rotation of the motors and to reduce electricity used by the motors.

For example, assuming that the intake fan gets noisier as the wind speed increases. At that time, the present invention allows for temporal increase in the wind speed, and thus allows for reduction of the noise as a whole, compared with a case where the intake fan is rotated always at the same wind speed.

With reference to later-mentioned examples, the following explains a relation between the wind speed and charge unevenness in the intake/exhaust system 60 provided near the charger 5 in the image forming apparatus having the foregoing arrangement.

Figure 8:
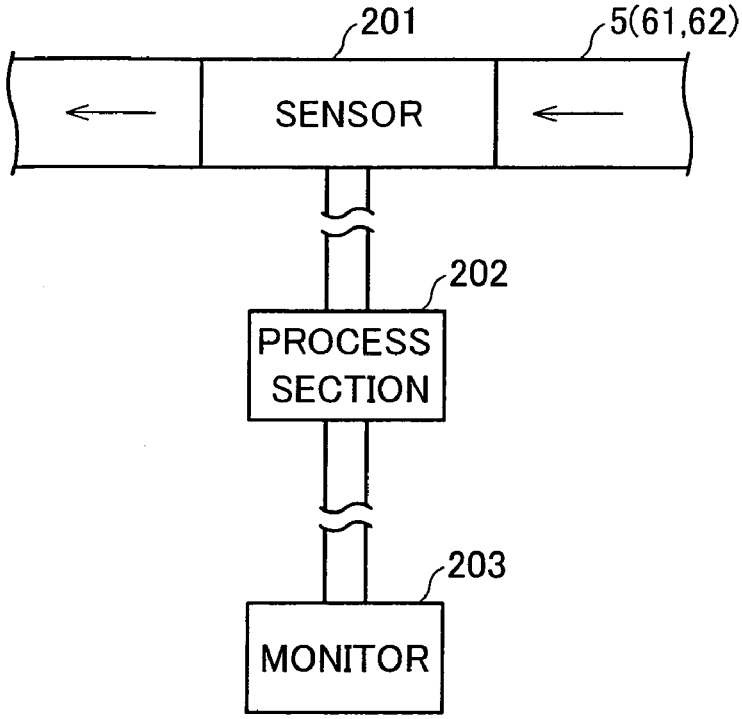
FIG. 8 schematically illustrates a device for measuring wind speed.
Figure 9:
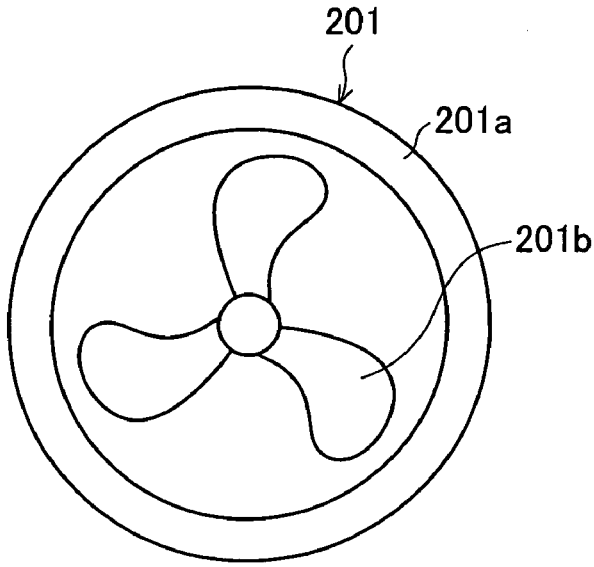
FIG. 9 is a cross sectional view schematically illustrating a sensor included in the device illustrated in FIG. 8.

With reference to FIGS. 8 and 9, the following explains a device for measuring the wind speed in the intake/exhaust system. Here, the wind speed in the charger 5 and the wind speed in the intake duct 61 and the exhaust duct 62 constituting the intake/exhaust system are measured.

As illustrated in FIG. 8, each of the charger 5, the intake duct 61 and the exhaust duct 62 is provided with a sensor 201 for detecting the wind speed. A value detected by the sensor 201 is inputted to a process section 202 and is subject to a predetermined process, and then information indicative of the wind speed is displayed on a monitor 203.

As illustrated in FIG. 9, the sensor 201 has a structure in which a rotating section 201*b* having a propeller shape is provided in a cylindrical section 201*a*. The sensor 201 is used to measure the wind speed in a direction vertical to a plane of the paper FIG. 9. Namely, an electric signal is obtained from the rotating section 201*b* at a time when air passing through the cylindrical section 201*a* rotates the rotating section 201*b*, and the sensor 201 outputs, as a value of detected speed, the electric signal to the process section 202.

An example of the sensor 201 is THERM 2285-2 (Ashburn Mess-und Regelugstechnik GmbH).

With reference to FIG. 10, the following explains signs with which degrees of charge unevenness are measured.

As illustrated in FIG. 10, "○" indicates a state where no streak is generated, "○Δ" indicates a state where a few thin streaks are generated, "Δ" indicates a state where thin streaks are generated overall, "ΔX" indicates a state where one or more thick streaks are generated, and "X" indicates a state where thick streaks are generated overall. Note that, states of the charge unevenness are determined by observing a 16-gradation pattern printed on a paper as a printed sample. The state of "Δ" is regarded as occurrence of charge unevenness, which is explained in the following.

Figure 12:
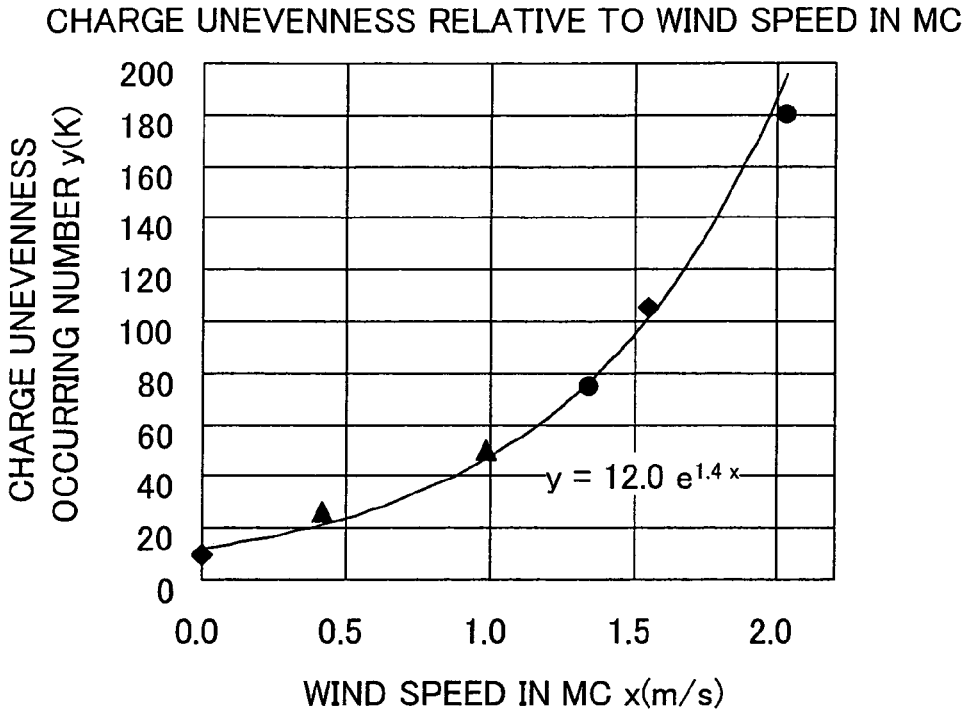
FIG. 12 is a graph illustrating a relation between wind speed in MC and charge-unevenness-occurring number. The relation is obtained based on the results in FIG. 11.
Figure 13:
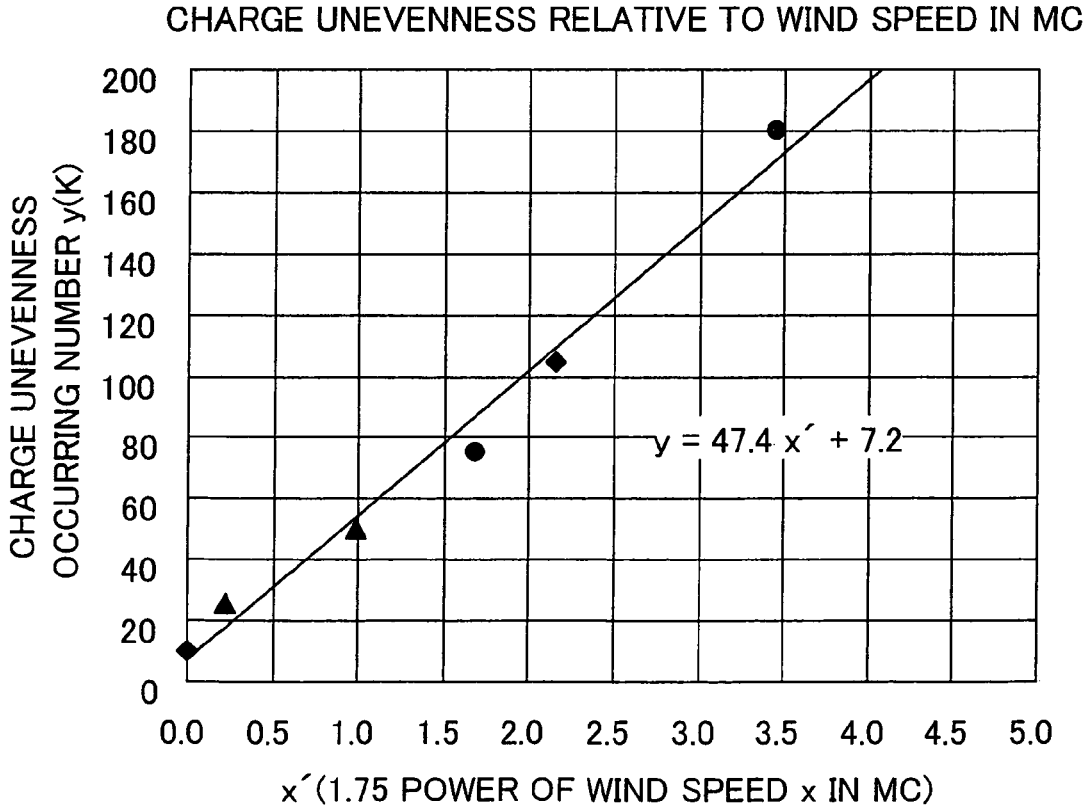
FIG. 13 is a graph illustrating a relation between wind speed in MC and charge-unevenness-occurring number. The relation is obtained based on the results in FIG. 11.

With reference to FIGS. 11 to 13, the following explains a relation between (i) a wind speed difference (a difference between the wind speed at the intake side and the wind speed at the exhaust side) in the intake/exhaust system and (ii) the number of papers at which the state of "Δ", level indicative of charge unevenness occurs (the number is referred to as charge-unevenness-occurring number hereinafter).

FIG. 11 is a table illustrating results of measuring (i) the wind speed in an intake section (the intake duct 61 side), (ii) the wind speed in an exhaust section (the exhaust duct 62 side), (iii) the wind speed in the charger 5 (MC), and (iv) charge-unevenness-occurring number in the intake/exhaust system 60. Here, four sheets of A4 documents were repeatedly printed by using only black toner and thus aging tests were performed. Reference papers used for printing had 5% band pattern. The measurement reference was the number of printed papers at a time when the charge unevenness reaches "Δ" level. Further, the wind speed in the exhaust section was set to a constant value (2.12 m/s) and the wind speed in the intake section was varied so as to produce a wind speed difference in the MC.

The results in FIG. 11 show that: as the wind speed in the MC is higher, charge-unevenness-occurring number is larger. Namely, as the wind speed in the MC is higher, charge unevenness is less likely to occur. The wind speed in the MC is the speed of the gas flow between the photoconductor drum 3 and the charger 5.

FIG. 12 is a graph obtained from the result of FIG. 11 so that the wind speed in the MC is x (m/s) and the charge-unevenness-occurring number (the number of printed images at a time when a formed image is judged to be influenced by charge defect on the basis of a predetermined reference) is y (1000). Here, the predetermined reference is the reference illustrated in FIG. 10. In this case, the predetermined reference is Δ.

The approximate expression obtained from the graph in FIG. 12 is $y=12.0e^{1.4X}$. In the graph, a scope indicating a preferable relation between the wind speed in the MC and charge-unevenness-occurring number is a scope defined by $y \leqq 12.0e^{1.4X}$ (a scope in the lower right of the graph).

Further, a turbulent flow may occur in the MC. At that time, it is necessary to change the above approximate expression. Namely, results obtained by the 1.75 power of the wind speeds in the MC illustrated in FIG. 11 are regarded as x' (m/s). A relation between x' and charge-unevenness-occurring number y is a graph illustrated in FIG. 13. The approximate expression obtained from the graph is $y=47.4x'+7.2$. In the graph, a scope indicating a preferable relation between x' and charge-unevenness-occurring number y is a scope defined by $y \leqq 47.4x'+7.2$ (a scope in the lower right of the graph).

The foregoing results show that: as the wind speed in the charger 5 is higher, charge unevenness is less likely to occur.

Here, the results in FIG. 11 show that: it is preferable to set the wind speeds in the intake section and the exhaust section so that the wind speed of the intake section is 1.9 times or more as high as the wind speed in the exhaust section and 4.2 times or less as high as the wind speed in the exhaust section. Namely, when the wind speed in the intake section is 4.00 m/s and the wind speed in the exhaust section is 2.12 m/s, the wind speed in the intake section is approximately 1.9 times as high as the wind speed in the exhaust section. Further, when the wind speed in the intake section is 8.92 m/s and the wind speed in the exhaust section is 2.12 m/s, the wind speed in the intake section is approximately 4.2 times as high as the wind speed in the exhaust section. Further, when the wind speed in the intake section is more than 4.2 times as high as the wind speed in the exhaust section, initial charge unevenness occurs. Namely, the initial charge unevenness is a state in which charge unevenness occurs from an initial state. This is not because foreign matters are attached to the discharge section but because the wind speed is too high. Namely, the grid section of the charger is vibrated due to the influence of the wind speed and accordingly a charge control of the photoconductor becomes unstable. As a result, variation in a potential is generated in a long-side direction of the photoconductor and accordingly charge unevenness which is not suitable for practical use occurs.

Further, for the following reason, it is preferable that the wind speed of gas flow in the MC is set to 1 m/sec or more and less than 2.5 m/sec. This is because: when the wind speed of the gas flow in the MC is less than 1 m/sec, there is substantially no effect (effect that charge unevenness is reduced) and when the wind speed of the gas flow in the MC is 2.5 m/sec or more, the initial charge unevenness occurs.

Here, the following explains results of experiments in which the wind speed in the intake section and the wind speed in the exhaust section included in the intake/exhaust system according to the present invention are varied.

FIG. 14 illustrates Experiment No. 1 in which charge-unevenness-occurring number was measured under a condition that a conventional process (a process in which the intake duct 61 and the exhaust duct 62 are not used unlike the present invention) was used and only exhaust wind speed was specified. Note that, there are two kinds of process speed: high speed (225 mm/s) and low speed (167 mm/s). The following Experiments No. 2 to No. 6 have the same process speeds. In Experiment No. 1, at the both process speeds, charge-unevenness-occurring number was 10 k.

Further, in Experiments No. 2 to No. 5, charge-unevenness-occurring number was measured under a condition that the intake/exhaust system illustrated in FIG. 1 was used, the exhaust wind speed was fixed to 2.21 m/s, and the intake wind speed was gradually increased so as to be 0 m/s, 4 m/s, 6 m/s, and 8.92/ms. In Experiments No. 4 and No. 5 out of these experiments, charge-unevenness-occurring number exceeded approximately 30 k which is charge-unevenness-occurring number suitable for practical use.

In Experiment No. 5, at the both process speeds, charge-unevenness-occurring number was 79 k or more. Out of Experiments No. 2 to No. 5, Experiment No. 5 has the most preferable relation between the intake wind speed and the exhaust wind speed.

Further, in Experiment No. 6, charge-unevenness-occurring number was measured under a condition that the exhaust wind speed was set to 5.05 m/s, which was higher than the exhaust wind speed in Experiments No. 2 to 5, and the intake wind speed was set to 0 m/s. In Experiment No. 6, when the process speed was low, charge-unevenness-occurring number was 20 k and when the process speed was high, charge-unevenness-occurring number was 10 k.

Figures 17, 18:
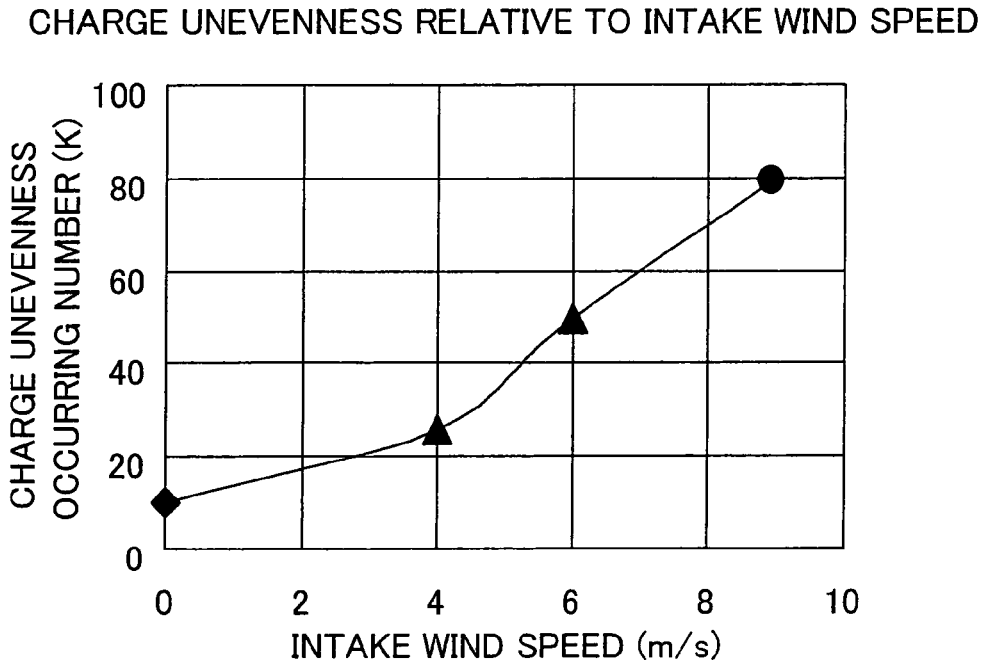
FIG. 17 illustrates the results of intake wind and charge-unevenness-occurring number in the Experiments No. 2 to No. 5.
FIG. 18 is a graph illustrating intake wind speed and charge-unevenness-occurring number. The graph is obtained based on the results in FIG. 17.

The table in FIG. 17 illustrates a relation between the intake wind speed and charge-unevenness-occurring number based on the results of Experiments No. 2 to No. 5. FIG. 18 illustrates a graph obtained from the results. The graph indicates an influence of the intake wind speed on the charge-unevenness-occurring number. Namely, it is found that: as the intake wind speed becomes higher, the charge-unevenness-occurring number becomes larger.

Next, unlike Experiments No. 1 to No. 6, Experiments No. 7 to No. 12 illustrated in FIG. 15 are experiments for confirming charge-unevenness-occurring number at a time when a color image is formed, namely, at a time when chargers 5 exist as many as four. Therefore, the exhaust wind speed and the intake wind speed are set with respect to each charger 5 corresponding to each hue.

In Experiment No. 7, charge-unevenness-occurring number was measured under a condition that a conventional process (process in which the intake duct 61 and the exhaust duct 62 were not used unlike the present invention) was used and only the exhaust wind speed was set. Note that, process speed was 167 mm/s in a case of color development and 225 mm/s in a case of monochrome development. The following Experiments No. 8 to No. 12 have the same process speeds. In Experiment No. 7, the charge-unevenness-occurring number was 10 k.

Further, in Experiments No 8. to No 10, charge-unevenness-occurring number was measured under a condition that the exhaust wind speed was increased by using the intake/exhaust system illustrated in FIG. 1. None of the charge-unevenness-occurring numbers of Experiments No. 8 to No. 10 exceed approximately 30 k which is the charge-unevenness-occurring number suitable for practical use.

In Experiment No. 11, as with Experiment No. 7, charge-unevenness-occurring number was measured under a condition that a conventional process (process in which the intake duct 61 and the exhaust duct 62 were not used unlike the present invention) was used and only the exhaust wind speed was set.

Experiment No. 12 was the same as Experiment No. 11 in terms of the intake wind speed and the exhaust wind speed except that: charge-unevenness-occurring number was measured while the charger case 51 of the charger 5 was sealed with urethane seal so as to increase exhaust efficiency.

Further, in Experiment No. 13 illustrated in FIG. 16, charge-unevenness-occurring number was measured under a condition that the intake/exhaust system illustrated in FIG. 1 was used, the intake wind speed was set to 0.85 m/s equal to speed of natural intake (wind speed measured at the entrance of the intake fan 63 of the intake duct 61), and the exhaust wind speed was set to 6.50 m/s with respect to a charger 5 which corresponds only to black. In Experiment No. 13, the charge-unevenness-occurring number suitable for practical use was not obtained.

FIG. 19 is a table illustrating the results of Experiments No. 6 to No. 13 and No. 2.

The results of FIG. 19 show that: in cases of experiments in which the exhaust wind speed was increased, none of the experiments realized charge-unevenness-occurring number suitable for practical use (approximately 30 k). Namely, it is impossible to increase the wind speed in the charger 5 merely by increasing the exhaust wind speed.

As described above, in the image forming apparatus according to the present invention, the intake/exhaust system 60 carries out intake and exhaust so as to generate a gas flow between the photoconductor drum 3 and the charger 5 in a long side direction of the charger 5, and thus allows a gas near the charger 5 to be always exhausted. Here, in a case where a corona discharge method is used for the charger 5, $O_3$, NOx, and the like are generated due to corona discharge. In that case, as described above, $O_3$, NOx, and the like are exhausted by a gas flow which exists near the charger 5 in a direction of the charger 5.

As a result, even when the charger 5 is used more frequently, $O_3$, NOx, and the like which are causes of charge defect are less likely to be accumulated near the charger 5, so that it is possible to reduce occurrence of charge defect (charge unevenness) in the charger 5. As a result, it is possible to always form a high-quality image which is free from deterioration of an image caused by charge unevenness.

The intake/exhaust system 60 includes (i) the intake duct 61 for introducing gas from an outside to a space between the photoconductor drum 3 and the charger 5 and (ii) the exhaust duct 62 for exhausting the gas from the space between the photoconductor drum 3 and the charger 5 to the outside.

Therefore, in a case where the wind speed of the gas at the intake side is constant, use of the intake duct 61 allows more effective introduction of the gas to the space between the photoconductor drum 3 and the charger 5 than when the intake duct 61 is not used. Further, in a case where the wind speed of the gas at the exhaust side is constant, use of the exhaust duct 62 allows more effective exhaust of the gas between the photoconductor drum 3 and the charger 5 than when the exhaust duct 62 is not used. As such, in a case where the wind speed of the gas at the intake side and the wind speed of the gas at the exhaust side are constant, using the intake duct 61 and the exhaust duct 52 allow increase in the wind speed of the gas flowing between the photoconductor drum 3 and the charger 5.

Therefore, it is possible to effectively reduce charge defect by using less energy.

Further, in order to effectively increase the wind speed of the gas flowing between the photoconductor drum 3 and the charger 5, the intake duct 61 should be provided with the intake fan 63 and the exhaust duct 62 should be provided with the exhaust fan 65.

Note that, the intake/exhaust system 60 may be arranged so that: instead of the intake duct 61 and the exhaust duct 62, the intake side of the gas flow is provide with the intake fan 63 and the exhaust side of the gas flow is provided with the exhaust fan 65.

In this case, though not so prominent as a case where the intake duct and the exhaust duct are provided, it is possible to increase the wind speed of the gas between the photoconductor drum 3 and the charger 5 compared with a case where the intake fan and the exhaust fan are not provided.

Further, the results of the above experiments show that: in order to increase the wind speed of the gas between the photoconductor drum 3 and the charger 5, it is preferable to arrange so that the wind speed at the intake side for introducing gas to the space between the photoconductor drum 3 and the charger 5 should be set to have a larger value than the wind speed at the exhaust side for exhausting gas from the space between the photoconductor drum 3 and the charger 5.

Further, it is preferable that the wind speed at the intake side is set to have a value ranging from 1.9 times to 4.2 times as high as the wind speed at the exhaust side.

At that time, when the wind speed of the intake side is less than 1.9 times as high as the wind speed at the exhaust side, it is impossible to sufficiently increase the wind speed of gas between the image carrier and the charger, so that $O_3$ and the like is accumulated and charge defect is likely to occur.

Further, when the wind speed of the intake side is more than 4.2 times as high as the wind speed of the exhaust side, the wind speed of the gas between the image carrier and the charger becomes too high and accordingly initial charge defect is likely to occur. The initial charge defect is a state in which charge defect always occurs from an initial state.

As described above, the image forming apparatus according to the present embodiment allows suitable exhaust of $O_3$ and the like floating near the charger 5 even when the charger 5 is used for a longer time, thereby forming an image with high quality, which is free from the influence of charge unevenness.

In this way, the present invention is favorably used for a laser printer and the like, and particularly for an image forming apparatus based on the electrophotography method, which adopts a charging method likely to cause $O_3$, NOx, and the like due to corona discharge.

As described above, an image forming apparatus according to the present invention includes (i) one or more image carriers each of which forms an electrostatic latent image on a surface of the image carrier and (ii) one or more chargers each of which is disposed near the image carrier and charges the surface of the image carrier, the image forming apparatus comprising gas flow generation means for carrying out intake and exhaust so as to generate a gas flow between the image carrier and the charger in a long side direction of the charger.

The gas flow generation means may include (i) an intake duct for introducing gas from an outside to a space between the image carrier and the charger and (ii) an exhaust duct for exhausting the gas from the space between the image carrier and the charger to the outside.

In this case, assuming that the wind speed of gas at an intake side is constant, use of the intake duct allows more effective introduction of gas to the space between the image carrier and the charger than when the intake duct is not used. Further, assuming that the wind speed of gas at an exhaust side is constant, use of the exhaust duct allows more effective exhaust of gas which exists between the image carrier and the charger than when the exhaust duct is not used. As a result, assuming that the wind speed of the gas at the intake side and the wind speed of the gas at the exhaust side are constant, use of the intake duct and the exhaust duct allows increase in the wind speed of the gas existing between the image carrier and the charger.

Therefore, it is possible to effectively reduce charge defect merely with small energy.

Further, in order to effectively increase the wind speed of gas existing between the image carrier and the charger, the intake duct may be provided with an intake fan and the exhaust duct may be provided with an exhaust fan.

Note that, the gas flow generation means may be arranged so that the gas flow generation means does not include the intake duct and the exhaust duct but includes (i) a intake fan which is disposed at the intake side from which the gas flows and (ii) an exhaust fan which is disposed at the exhaust side to which the gas flows.

In this case, though not so prominent as a case where the intake duct and the exhaust duct are provided, it is possible to increase the wind speed of the gas between the image carrier and the charger compared with a case where the intake fan and the exhaust fan are not provided.

The image forming apparatus according to the present invention is arranged so that: rotational frequency control means for controlling rotational frequencies of the intake fan and the exhaust fan sets (i) wind speed at a intake side for introducing gas to a space between the image carrier and the charger and (ii) wind speed at an exhaust side for exhausting gas from the space between the image carrier and the charger.

In order to increase the wind speed of the gas between the image carrier and the charger, it is preferable to arrange so that the wind speed at the intake side for introducing gas to the space between the image carrier and the charger is set so as to have a larger value than the wind speed at the exhaust side for exhausting gas from the space between the image carrier and the charger.

Further, it is preferable to arrange so that the wind speed at the intake side is set so as to have a value ranging from 1.9 times to 4.2 times as large as the wind speed at the exhaust side.

At that time, when the wind speed of the intake side is less than 1.9 times as high as the wind speed at the exhaust side, it is impossible to sufficiently increase the wind speed of gas between the image carrier and the charger, so that $O_3$ and the like are accumulated and charge defect is likely to occur.

Further, when the wind speed of the intake side is more than 4.2 times as high as the wind speed of the exhaust side, the wind speed of gas between the image carrier and the charger becomes too high and accordingly initial charge defect is likely to occur. The initial charge defect is a state in which charge defect always occurs from an initial state.

Further, the gas flow generation means is more favorably used when the charger is a corona charger and is disposed under the image carrier.

This is because: in a case where the charger exists under the image carrier, corona discharge is performed upward, so that $O_3$ and the like are likely to be accumulated in the charger. Namely, in a case where $O_3$ and the like are likely to be accumulated, it is very effective to use means such as the gas flow generation means for forcing the accumulated $O_3$ and the like to be exhausted.

The gas flow generation means is favorably applicable to an image forming apparatus in which the image carrier is provided with the chargers in plurality.

An example of such image forming apparatus is a high speed printing apparatus which needs a surface of an image carrier to be charged at high speed.

Further, the gas flow generation means is favorably applicable to an image forming apparatus in which the image carriers are provided in plurality, and a charger is provided on each of the image carriers.

An example of such image forming apparatus is an image forming apparatus having a tandem system, in which image carriers are provided so as to respectively correspond to inks for forming a color image.

Further, it is preferable to arrange so that: a relational expression $y \leqq 12.0e^{1.4x}$ is satisfied where wind speed of a gas flow between the image carrier and the charger is x (m/s) and the number of images which are formed from a time when the image carrier starts to form an image to a time when an image is judged to be influenced by charge defect is y (1000).

Further, it is preferable to arrange so that: when a gas flow between the image carrier and the charger is a turbulent flow, a relational expression $y \leqq 47.4x+7.2$ is satisfied where wind speed of the gas flow is x (m/s) and the number of images which are formed from a time when the image carrier starts to form an image to a time when an image is judged to be influenced by charge defect is y (1000).

It is preferable to arrange so that wind speed of a gas flow between the image carrier and the charger is set to 1 m/sec or more and less than 2.5 m/sec. This is because: when the wind speed of the gas flow in the MC is less than 1 m/sec, there is substantially no effect (effect that charge unevenness is reduced) and when the wind speed of the gas flow in the MC is 2.5 m/sec or more, the initial charge unevenness occurs.

The image forming apparatus according to the present invention may be arranged so as to include (i) a sensor for detecting density of $O_3$ and NOx accumulated between the image carrier and the charger, and (ii) wind speed control means for controlling wind speed of gas existing between the image carrier and the charger on the basis of a value detected by the sensor.

Amounts of accumulated $O_3$ and NOx, namely, amounts of floating $O_3$ and NOx change depending on how much time has passed since charging started. At that time, installation of the sensor realizes the following condition: when the amounts of floating $O_3$ and NOx are small, the wind speed is made lower, and when the amount of floating $O_3$ and NOx are large, the wind speed is made higher, thereby allowing suitable exhaustion of $O_3$ and NOx according to atmosphere near the charger.

The present invention is applicable to an image forming apparatus based on an electrophotography method, particularly to an image forming apparatus including a charger in a corona discharge method.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, including (i) one or more image carriers each of which forms an electrostatic latent image on a surface of the image carrier and (ii) one or more chargers each of which is disposed near the image carrier and charges the surface of the image carrier, said image forming apparatus comprising:

gas flow generation means for carrying out intake and exhaust so as to generate a gas flow between the image carrier and the charger in a long side direction of the charger, and wind speed control means for controlling wind speed of gas flowing between the image carrier and the charger, wherein a relational expression (1) is satisfied $$y \leqq 12.0e^{1.4x} \quad (1)$$

where wind speed of a gas flow between the image carrier and the charger is x (m/s), and the number of images which are formed from a time when the image carrier starts to form an image to a time when an image is judged to be influenced by charge defect is y (1000).

2. The image forming apparatus as set forth in claim 1, wherein the gas flow generation means includes (i) an intake duct for introducing gas from an outside to a space between the image carrier and the charger and (ii) an exhaust duct for exhausting the gas from the space between the image carrier and the charger to the outside.

3. The image forming apparatus as set forth in claim 2, wherein the intake duct is provided with an intake fan and the exhaust duct is provided with an exhaust fan.

4. The image forming apparatus as set forth in claim 1, wherein the gas flow generation means includes (i) an intake fan which is disposed at an intake side and introduces gas from an outside and (ii) an exhaust fan which is disposed at an exhaust side and exhausts the gas to the outside.

5. The image forming apparatus as set forth in claim 3, wherein rotational frequency control means for controlling rotational frequencies of the intake fan and the exhaust fan sets (i) wind speed at an intake side for introducing gas to a space between the image carrier and the charger and (ii) wind speed at an exhaust side for exhausting the gas from the space between the image carrier and the charger.

6. The image forming apparatus as set forth in claim 4, wherein rotational frequency control means for controlling rotational frequencies of the intake fan and the exhaust fan sets (i) wind speed at an intake side for introducing gas to a space between the image carrier and the charger and (ii) wind speed at an exhaust side for exhausting the gas from the space between the image carrier and the charger.

7. An image forming apparatus, including (i) one or more image carriers each of which forms an electrostatic latent image on a surface of the image carrier and (ii) one or more chargers each of which is disposed near the image carrier and charges the surface of the image carrier, said image forming apparatus comprising gas flow generation means for carrying out intake and exhaust so as to generate a gas flow between the image carrier and the charger in a long side direction of the charger, wherein the gas flow generation means includes (i) an intake duct for introducing gas from an outside to a space between the image carrier and the charger and (ii) an exhaust duct for exhausting the gas from the space between the image carrier and the charger to the outside, wherein the intake duct is provided with an intake fan and the exhaust duct is provided with an exhaust fan, wherein wind speed at an intake side for introducing gas to a space between the image carrier and the charger is set so as to have a larger value than wind speed at an exhaust side for exhausting the gas from the space between the image carrier and the charger.

8. An image forming apparatus, including (i) one or more image carriers each of which forms an electrostatic latent image on a surface of the image carrier and (ii) one or more chargers each of which is disposed near the image carrier and charges the surface of the image carrier, said image forming apparatus comprising gas flow generation means for carrying out intake and exhaust so as to generate a gas flow between the image carrier and the charger in a long side direction of the charger, wherein the gas flow generation means includes (i) an intake fan which is disposed at an intake side and introduces gas from an outside and (ii) an exhaust fan which is disposed at an exhaust side and exhausts the gas to the outside, wherein wind speed at the intake side for introducing gas to a space between the image carrier and the charger is set so as to have a larger value than wind speed at the exhaust side for exhausting the gas from the space between the image carrier and the charger.

9. The image forming apparatus as set forth in claim 7, wherein the wind speed at the intake side is set so as to have a value ranging from 1.9 times to 4.2 times as large as the wind speed at the exhaust side.

10. The image forming apparatus as set forth in claim 8, wherein the wind speed at the intake side is set so as to have a value ranging from 1.9 times to 4.2 times as large as the wind speed at the exhaust side.

11. The image forming apparatus as set forth in claim 1, wherein the charger is a corona charger and is disposed under the image carrier.

12. The image forming apparatus as set forth in claim 1, wherein the image carrier is provided with the chargers in plurality.

13. The image forming apparatus as set forth in claim 1, wherein the image carriers are provided in plurality, and a charger is provided on each of the image carriers.

14. An image forming apparatus, including (i) one or more image carriers each of which forms an electrostatic latent image on a surface of the image carrier and (ii) one or more chargers each of which is disposed near the image carrier and charges the surface of the image carrier, said image forming apparatus comprising:

gas flow generation means for carrying out intake and exhaust so as to generate a gas flow between the image carrier and the charger in a long side direction of the charger, and wind speed control means for controlling wind speed of gas flowing between the image carrier and the charger, wherein: when a gas flow between the image carrier and the charger is a turbulent flow, a relational expression (2) is satisfied $$y \leqq 47.4x + 7.2 \quad (2)$$

where wind speed of the gas flow is x (m/s), and the number of images which are formed from a time when the image carrier starts to form an image to a time when an image is judged to be influenced by charge defect is y (1000).

15. The image forming apparatus as set forth in claim 1, comprising density detection means for detecting density of at least one of $O_3$ and NOx accumulated between the image carrier and the charger, and the wind speed control means controls wind speed of gas flow on the basis of a value detected by the density detection means.

16. An intake/exhaust system, which carries out intake and exhaust so as to generate an air flow between (i) an image carrier for forming an electrostatic latent image on a surface of the image carrier and (ii) a charger for charging the surface of the image carrier, said air flow being in a long side direction of the charger, said intake/exhaust system controls wind speed of gas flowing between the image carrier and the charger, wherein a relational expression (1) is satisfied $$y \leqq 12.0e^{1.4x} \quad (1)$$

where wind speed of a gas flow between the image carrier and the charger is x (m/s), and the number of images which are formed from a time when the image carrier starts to form an image to a time when an image is judged to be influenced by charge defect is y (1000).

17. An intake/exhaust system, which carries out intake and exhaust so as to generate an air flow between (i) an image carrier for forming an electrostatic latent image on a surface of the image carrier and (ii) a charger for charging the surface of the image carrier, said air flow being in a long side direction of the charger, said intake/exhaust system controls wind speed of gas flowing between the image carrier and the charger, wherein: when a gas flow between the image carrier and the charger is a turbulent flow, a relational expression (2) is satisfied $$y \leqq 47.4x + 7.2 \quad (2)$$

where wind speed of the gas flow is x (m/s), and the number of images which are formed from a time when the image carrier starts to form an image to a time when an image is judged to be influenced by charge defect is y (1000).

18. The image forming apparatus as set forth in claim 14, wherein the gas flow generation means includes (i) an intake duct for introducing gas from an outside to a space between the image carrier and the charger and (ii) an exhaust duct for exhausting the gas from the space between the image carrier and the charger to the outside.

19. The image forming apparatus as set forth in claim 18, wherein the intake duct is provided with an intake fan and the exhaust duct is provided with an exhaust fan.

20. The image forming apparatus as set forth in claim 14, wherein the gas flow generation means includes (i) an intake fan which is disposed at an intake side and introduces gas from an outside and (ii) an exhaust fan which is disposed at an exhaust side and exhausts the gas to the outside.

21. The image forming apparatus as set forth in claim 19, wherein rotational frequency control means for controlling rotational frequencies of the intake fan and the exhaust fan sets (i) wind speed at an intake side for introducing gas to a space between the image carrier and the charger and (ii) wind speed at an exhaust side for exhausting the gas from the space between the image carrier and the charger.

22. The image forming apparatus as set forth in claim 20, wherein rotational frequency control means for controlling rotational frequencies of the intake fan and the exhaust fan sets (i) wind speed at an intake side for introducing gas to a space between the image carrier and the charger and (ii) wind speed at an exhaust side for exhausting the gas from the space between the image carrier and the charger.

23. The image forming apparatus as set forth in claim 14, wherein the charger is a corona charger and is disposed under the image carrier.

24. The image forming apparatus as set forth in claim 14, wherein the image carrier is provided with the chargers in plurality.

25. The image forming apparatus as set forth in claim 14, wherein the image carriers are provided in plurality, and a charger is provided on each of the image carriers.

26. The image forming apparatus as set forth in claim 14, comprising density detection means for detecting density of at least one of $O_3$ and NOx accumulated between the image carrier and the charger, and the wind speed control means controls wind speed of gas flow on the basis of a value detected by the density detection means.

27. The image forming apparatus as set forth in claim 7, wherein wind speed of a gas flow between the image carrier and the charger is set to 1 m/sec or more and less than 2.5 m/sec.

28. The image forming apparatus as set forth in claim 8, wherein wind speed of a gas flow between the image carrier and the charger is set to 1 m/sec or more and less than 2.5 m/sec.

* * * * *

UNITED STATES PATENT AND TRADEMARK OFFICE

CERTIFICATE OF CORRECTION

PATENT NO. : 7,616,912 B2
APPLICATION NO. : 11/444391
DATED : November 10, 2009
INVENTOR(S) : Nishimura et al.

It is certified that error appears in the above-identified patent and that said Letters Patent is hereby corrected as shown below:

Title Page, Item (54) and Col. 1, line 1-2, Title should read

IMAGE FORMING APPARATUS INCLUDING A CHARGER AND INTAKE/EXHAUST SYSTEM

Signed and Sealed this
Twenty-eighth Day of February, 2012

David J. Kappos

David J. Kappos
*Director of the United States Patent and Trademark Office*